United States Patent [19]

Wolf et al.

[11] Patent Number: 4,531,609

[45] Date of Patent: Jul. 30, 1985

[54] SOUND ABSORPTION PANEL

[75] Inventors: Jerry M. Wolf, Westerville; Wilbur D. Holben, Ostrander, both of Ohio

[73] Assignee: Midwest Acounst-A-Fiber, Ostrander, Ohio

[21] Appl. No.: 623,109

[22] Filed: Jun. 22, 1984

Related U.S. Application Data

[63] Continuation-in-part of Ser. No. 526,894, Aug. 6, 1983, Pat. No. 4,496,024.

[51] Int. Cl.[3] ..... E04B 1/82; E04B 2/02

[52] U.S. Cl. ..... 181/290; 181/294; 181/286; 428/163; 428/167; 428/182

[58] Field of Search ..... 181/290, 295, 288, 287, 181/291, 293, 286, 294, 284; 428/163, 167, 181, 182

[56] References Cited

U.S. PATENT DOCUMENTS

| | | | |
|---|---|---|---|
| 2,373,039 | 4/1945 | MacChesney | 428/167 X |
| 2,419,971 | 5/1947 | Rumpf et al. | 181/290 X |
| 4,170,674 | 10/1979 | Matsuki | 181/293 X |
| 4,213,516 | 7/1980 | Sulewsky | 181/286 |

FOREIGN PATENT DOCUMENTS

| | | | |
|---|---|---|---|
| 986419 | 7/1951 | France | 181/293 |

*Primary Examiner*—L. T. Hix
*Assistant Examiner*—Brian W. Brown
*Attorney, Agent, or Firm*—Sidney W. Millard

[57] ABSTRACT

Two pelts of fiberglass are bonded together to form a sound absorption panel. One pelt is deformed to a sawtooth shape and the teeth of the sawtooth pelts are bonded into grooves in the other pelt which is essentially flat except for the grooves.

2 Claims, 5 Drawing Figures

SOUND ABSORPTION PANEL

This is a continuation-in-part application of application Ser. No. 526,894 filed Aug. 6, 1983, now U.S. Pat. No. 4,496,024.

FIELD OF THE INVENTION

This invention relates to sound absorption panels, their method of making and apparatus for making.

BACKGROUND OF THE INVENTION

Sound absorption panels typically involve porous and/or contoured surfaces designed to baffle the sound waves impinging on the surface thereof. The idea is to bounce the sound waves around, in or on the panel such that the reflected sound wave is much lower in volume that the one first impinging. Such panels are often used in office complexes as divider walls or between offices to prevent sound from carrying throughout the area.

An example of the kind of problem which exists is a printer used with word processors in business offices. Often the volume of sound created during the printing procedure is so great that it is difficult for the staff to talk on the phone while the printer is running. As a consequence, remote printers are common. The keyboard will be located in one room while the printer is located in another room or in the case of a large room filled with a number of desks, the desks will be separated by sound absorption panels and the printer will be located in a relatively remote area of the room almost completely surrounded by absorption panels. Panels around the printer will absorb some sound and reflect other sound upwardly toward the ceiling where other sound absorption panels of a different sort may exist.

The dampening of the sounds in a theater environment is another important structural problem because the typical cavernous area tends to echo the sounds projected from the entertainment stage or associated speakers. The problem of echoes has been solved to a limited extent by the hanging of heavy convoluted drapes along the walls of the theater. More recent designs for sound absorbing side walls include convoluted, fabric covered curtain walls of various structural materials.

The fact that research is continuing on designs and materials to serve as sound absorbing panels to be used as divider walls or curtain walls shows the need for a more universally usable structure and as a consequence of this need, the herein disclosed sound absorbing panel has been designed.

SUMMARY OF THE INVENTION

The sound absorbing panel of this invention includes a pair of fiberglass pelts deformed into desired shapes in especially designed platen presses. The resulting deformed pelts are then assembled together and adhesively joined to form a single unit of fiberglass which is flat on one side and exhibits a series of V-shaped parallel grooves on the other side in a sawtooth arrangement.

It is intended that the panel be mounted with the grooves extending vertically and the grooved side of the panel facing toward the sound to be dampened.

For purposes of aesthetics and more importantly to prevent droppings from and contamination of the fiberglass pelt on the sawtooth side, a fabric is adhesively bonded to its surface. It is anticipated that the fabric will be more pleasing to the eye than the unadorned fiberglass surface, but the prime reason for the fabric is to prevent dust and dirt from collecting on the surface of the fiberglass and to prevent the dropping of small fiberglass particles as the panel stands in position. It is desirable that the fabric be soft in nature to provide a small amount of additional sound absorbing quality, but of course that is not absolutely vital. It is not desirable to have the fabric cover be of a vinyl nature because such would tend to reflect more sound than would be desired. The whole purpose of the sound absorbing panel is to let the sound penetrate the fiberglass pelts and rattle around on the inside before being reflected back out into the area where it originated at a much lower decibel level.

On the flat side of the panel an optional structural feature is a layer of aluminum foil which may be bonded to the surface of the fiberglass. The aluminum foil layer can serve two purposes, one as a vapor barrier and the other as a heat reflector.

Specific objects of the invention will be clear from a detailed reading of the preferred embodiment and a review of the drawing.

DESCRIPTION OF THE PREFERRED EMBODIMENT

Figure 1:
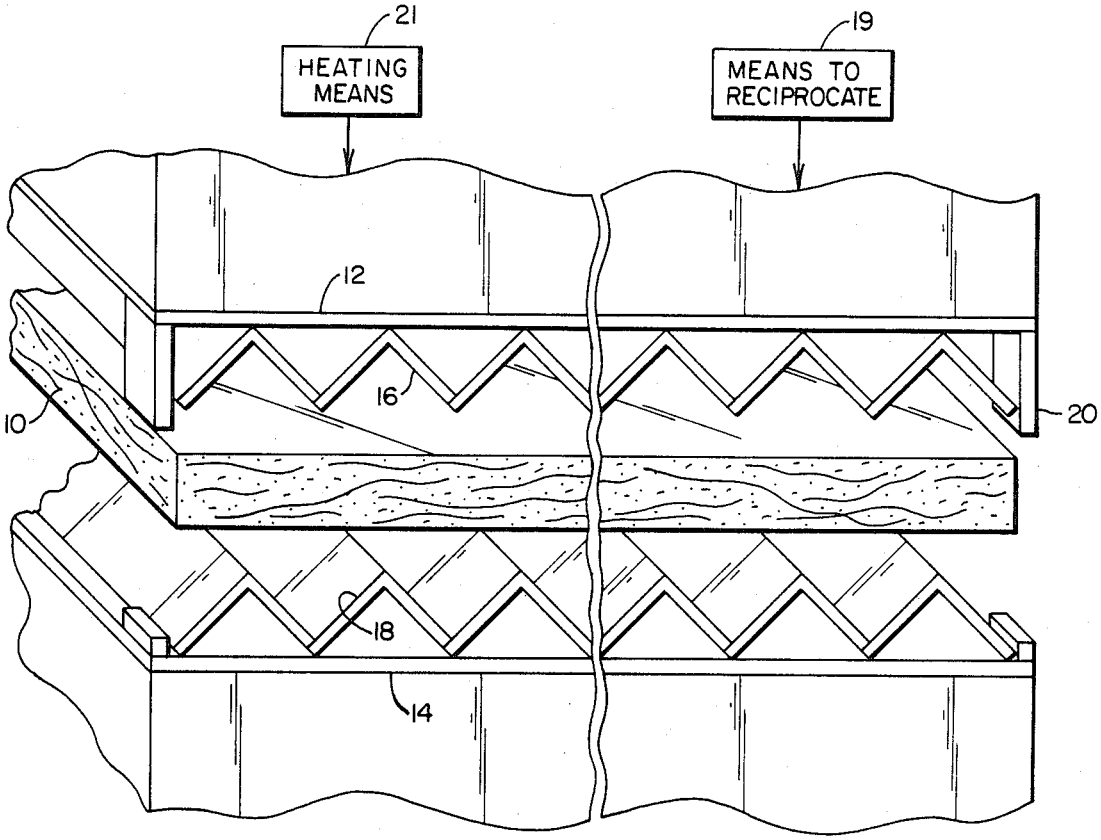
FIG. 1 is a fragmentary perspective view of a platen press with a fiberglass pelt in place for deformation.

FIG. 1 shows a pelt of fiberglass 10 as it is being inserted in a platen press which includes aligned, spaced plates 12 and 14 mounted for reciprocation toward and away from each other. The purpose of course is to deform and shape whatever is placed between the two plates, in this case the pelt 10.

In FIG. 1 the plates 12 and 14 are supplemented by a top face plate 16 which is the mirror image of bottom face plate 18.

The function of the platen press is to move the plates toward each other 19 with the pelt therebetween and to compress it while applying heat 21 so that it retains the shape into which it is formed by the face plates 16 and 18. In this particular structure the thickness of the deformed pelt is controlled by an outboard gauge or steel block 20 mounted along one edge of the press.

Untreated fiberglass will of course not retain any shape merely because of the application of heat. A typical fiberglass pelt has an initial thickness of about one inch (25.4 millimeters) and has a precompression density of about three-quarters to two and one-half pounds per cubic foot (12.1 to 40.3 kilograms per cubic meter) and a compressed density of about six to eighteen pounds per cubic foot (96.34 to 289.0 kilograms per cubic meter) and preferably has a phenolic resin content of sixteen to twenty-five percent by weight. The phenolic resin will cause the compressed and deformed fiberglass pelt to retain its deformed state upon the application of heat for a suitable period of time. For purposes of this invention a suitable period of time is one and one-half minutes to six minutes at temperatures in the range 350° to 525° F., depending upon the thickness of the initial pelt and the density thereof. As a specific example, a pelt one inch in thickness having a density of about one and one-half pounds per cubic foot compressed to a thickness of about one-eighth inch would require a time of about three minutes to cure at a temperature of about 475° F.

Figure 2:
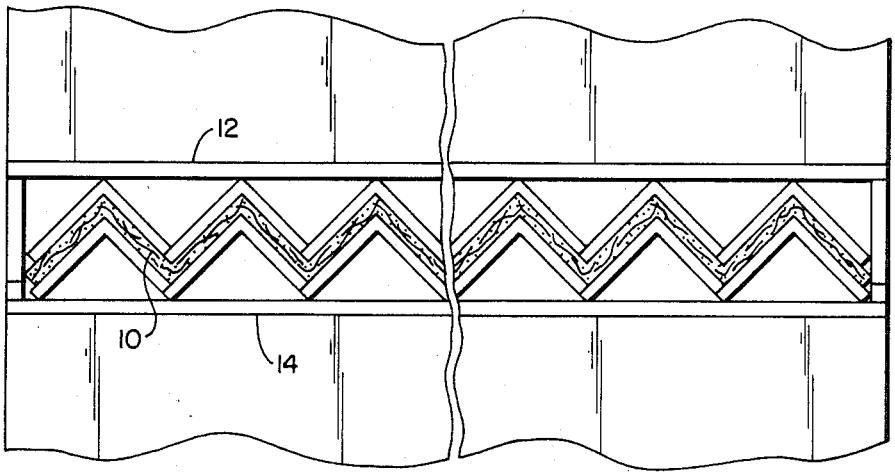
FIG. 2 is a fragmentary elevational view of the press and pelt of FIG. 1 with the press closed.
Figure 3:
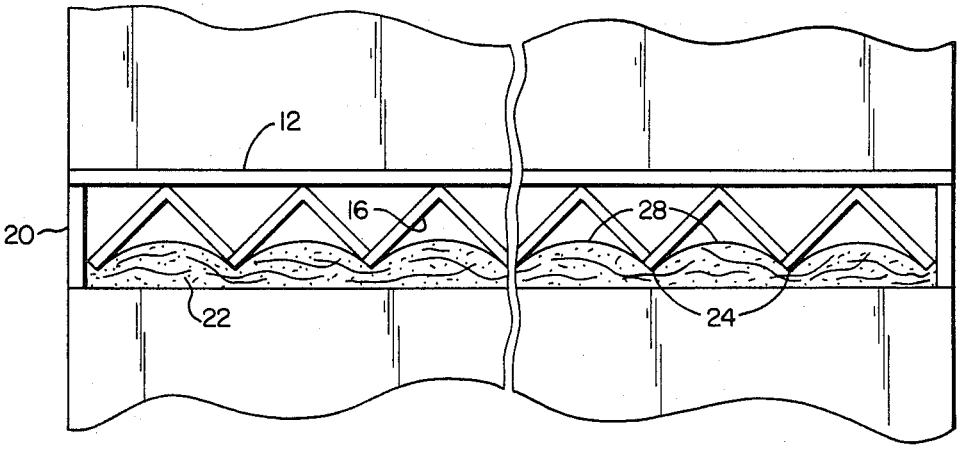
FIG. 3 is a fragmentary elevational view of the press in closed position with a new pelt being deformed and with the lower deforming element of FIG. 1 having been removed.
Figure 4:
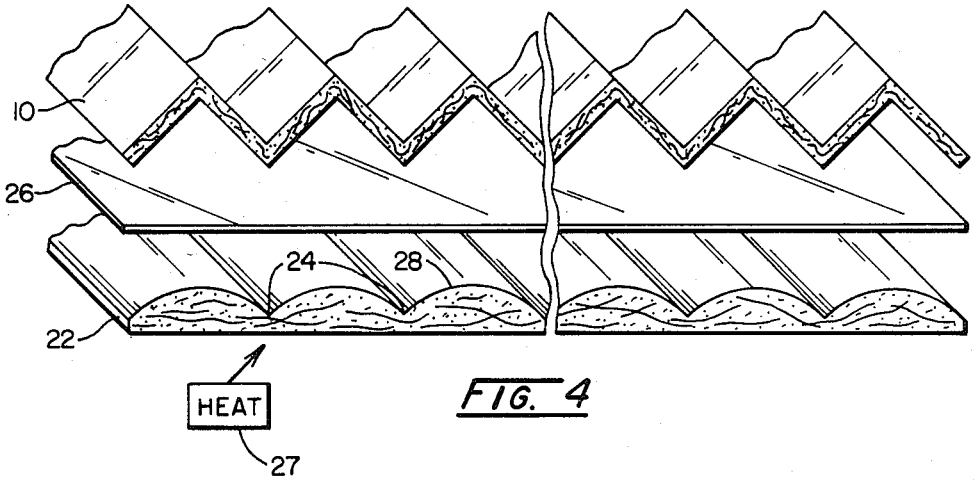
FIG. 4 is a fragmentary exploded view showing the assembly of two deformed pelts which have been deformed according to FIGS. 2 and 3 with a polymer sheet sandwiched therebetween.
Figure 5:
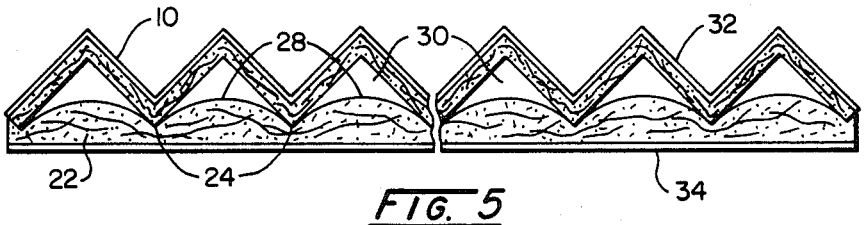
FIG. 5 is an elevational view of the panel assembled and bonded together with a fabric on the outer corrugated side and an aluminum foil sheet on the flat side.

After the first pelt 10 is formed according to FIG. 2 it is assembled with a second pelt 22 formed according to the platen shown in FIG. 3.

The second pelt 22 would have an initial thickness about the same as pelt 10 before it is inserted in the platen press.

The press of FIG. 3 shows a top face plate 16 the same as the top face plate of FIG. 1. The reason for that is to retain the dimensional relationship for the subsequent assembly of the two deformed pelts as will be explained subsequently.

The second pelt 22 is inserted between the platens and the two are brought together to deform pelt 22 while heating it and thereby form a series of parallel grooves 24 in the pelt which have the same dimensional spacing as the juxtaposed points on the deformed V-shaped pelt 10 of FIG. 2.

To have a permanent deforming and shaping characteristic for the second pelt 22 the platen of FIG. 3 should be in place from one to three minutes at a temperature in the range 350° to 525° F. In a more specific example, a one inch pelt inserted into the platen having a density of about one and one-half pounds per cubic foot is compressed at its lowest point to a one-eighth inch thickness for a time period of about two minutes at about 475° F.

After their deformations the pelts 10 and 22 are assembled with the V-shaped peaks of pelt 10 resting in the grooves 24 formed in the second pelt 22. In order to join these two pelts together an adhesive or bonding agent is required and while there may be other bonding agents, a satisfactory bond has been achieved by inserting a thin thermoplastic sheet 26 between the two and heating 27 the assembly for one minute at about 475°. The purpose is to melt the thermoplastic sheet and cause it to bond the two deformed pelts together after it cools. It is clear that various adhesives could be used but the most desired thermoplastic sheet is of polypropylene having a thickness in the range one-half to four mil (0.013 to 0.102 millimeters). Equivalent thermoplastic materials include polyethylene, polyvinylchloride and polyvinyl acetate.

The V-shaped or sawtooth design which will define the shape of the panel facing toward the sound to be dampened subtends an angle of about 90° and the purpose of this is to have the sound being received impinge on two surfaces at a minimum before it is reflected back out into the room from whence it came. It is anticipated that the majority of sound will be translated through the deformed pelt 10 which is of uniform thickness and will next impinge on the fluffed up section 28 of the pelt 22, intermediate the grooves 24, and this particular area will absorb a large portion of the sound absorbed by the panel.

It is clear from the prior description that the fluffed up section 28 will be of less density than the fiberglass of the deformed first pelt 10 and the deformed groove section 24 of the second pelt 22. The fluffed up section 28 which partially fills the void 30 between the two sides of each of the V-shapes of the first pelt 10 serves to disperse the impinging sound waves in diverse directions because of the general amorphous or random orientation of the fibers. The cavities or voids 30 are not completely filled but the degree of bulge of the fluffed section 28 is not critical.

To prevent the sloughing or dropping of small particles of the fiberglass from pelt 10 when the panel is assembled into an operable position, a fabric layer 32 is applied over the sawtooth surface of the panel. Some suitably effective adhesive may be applied to the sawtooth area or the back of the fabric layer and no particular adhesive is preferred as each fabric might have a different adhesive which would be effective for its bonding. The critical feature of the adhesive is that it not be so thickly applied as to form a dense rigid layer which might reflect sound from the panel without allowing the sound to partially penetrate the fiberglass area. The particular kind of fabric used should be a fluffy one of a porous nature rather than a vinyl structure which would provide a barrier against the absorption of sound.

If desired, an aluminum foil 34 may be applied to the flat side of the assembled panel and it serves the dual purpose of a heat reflection barrier as well as a moisture barrier. The need for either kind of barrier depends upon the particular application for which the panel is supplied.

Having thus described the invention it will be clear that certain modifications may be made without departing from the spirit of the invention. It is not intended that the words used to describe the invention nor the drawings illustrating the same be limiting on the invention. Rather it is intended that the invention be limited only by the scope of the appended claims.

We claim:

1. A sound absorbing panel comprising first and second layers of fiberglass partially in contact, the first layer being formed into a sawtooth shape, the second layer being flat on one side and having parallel grooves impressed into the other side, the two layers being assembled with the teeth of the first layer resting in and bonded to the grooves in the second layer, the fiberglass of the second layer intermediate the grooves is of less density than (1) the fiberglass at its grooves and (2) the fiberglass of the first layer, the fiberglass of the second layer intermediate the grooves fluffs up to fill part of the cavities formed by the sawtooth shape intermediate the grooves, a fabric layer bonded to and conforming to the sawtooth surface of the first layer on the surface facing away from the second layer.

2. The panel of claim 1 including a layer of aluminum foil bonded to the flat surface of the second layer.

* * * * *